US006234917B1

(12) United States Patent
Asakura

(10) Patent No.: US 6,234,917 B1
(45) **Date of Patent: *May 22, 2001**

(54) GOLF BALL

(75) Inventor: Takeshi Asakura, Fukuchiyama (JP)

(73) Assignee: Sumitomo Rubber Industries, Ltd., Hyogo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,079

(22) Filed: Sep. 4, 1998

(30) Foreign Application Priority Data

Nov. 6, 1997 (JP) ..... 9-322155

(51) Int. Cl.[7] ..... A63B 37/14
(52) U.S. Cl. ..... 473/378; 473/384
(58) Field of Search ..... 473/384, 378–385

(56) References Cited

U.S. PATENT DOCUMENTS 5,092,604 * 3/1992 Oka .
5,156,404 * 10/1992 Oka et al. ..... 473/384 X
5,415,410 * 5/1995 Aoyama .
5,735,756 * 4/1998 Stiefel ..... 473/382
5,902,193 * 5/1999 Shimosaka ..... 473/384

FOREIGN PATENT DOCUMENTS 8-10355 1/1996 (JP) .

* cited by examiner

*Primary Examiner*—Jeanette Chapman
*Assistant Examiner*—Stephen L. Blau
(74) *Attorney, Agent, or Firm*—Birch, Stewart, Kolasch & Birch, LLP

(57) ABSTRACT

A golf ball that plural kinds of dimples are disposed on a spherical face, and a great circle zone not including even a part of the dimples are formed on the spherical face. An imaginary great circle line is drawn on the great circle zone, and two intersections of the spherical face and a straight line, which is at right angles with a circular plane of which circumference is the imaginary great circle line, and goes through the center of the golf ball, are poles. And, in a ball hemispherical face of which border is the imaginary great circle line, when the spherical face is equally divided with imaginary arc lines which start from the pole and are at right angles with the imaginary great circle line, dimple dispositions of adjacent divided areas sharing an imaginary arc line are not line-symmetric with respect to the imaginary arc line, and the dimple dispositions of the divided areas are rotation-symmetric with respect to the straight line.

12 Claims, 8 Drawing Sheets

GOLF BALL

BACKGROUND OF THE INVENTION

1. Field of the Invention

This invention relates to a golf ball.

2. Description of the Related Art

Conventionally in a golf ball, plural kinds of dimples have been disposed on a spherical face in various design patterns for improving the flying ability of the golf ball. Furthermore, a great circle zone not crossing the dimples, namely, a seam line is on a position of the spherical face corresponding to a parting line of a metal mold for production of the golf ball.

The existence of the seam line, however, is a cause of aerodynamic asymmetry of the golf ball. That is to say, it is known that relatively great differences are generated in flying distance and flight time when the rotating direction (flying direction) of the ball corresponds to the seam line and when the rotating direction of the ball corresponds to a circumferential direction at right angles with the seam line. Therefore, it has been the aerodynamic symmetry of the golf ball by forming many great circle zones not crossing the dimples similar to the seam line on the spherical face, for example, a golf ball of geometrical high uniformity, in which a spherical face is divided with polyhedrons or quasi-polyhedrons, and dimples are disposed line-symmetrically in spherical polygons (Japanese Patent Provisional Publication No. 8-10355).

In a golf ball having many great circle zones on a spherical face, however, there is a defect in that flying distance decreases due to remarkable reduction of dimple effect because of the high probability of correspondence of a rotating direction of the golf ball and a direction of the great circle zone (not having dimples). Furthermore, there is another problem in that the degree of freedom of design is very low because there are a limited number of patterns which can divide the sphere with polyhedrons or quasi-polyhedrons, and the dimple disposition is line-symmetric in the spherical polygons. Therefore, the dimple disposition still needs to be improved.

SUMMARY OF THE INVENTION

It is therefore an object of the present invention to provide a golf ball in which stable flying ability can be obtained by improved aerodynamic symmetry, and degree of freedom in designing dimple disposition is high. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 2:
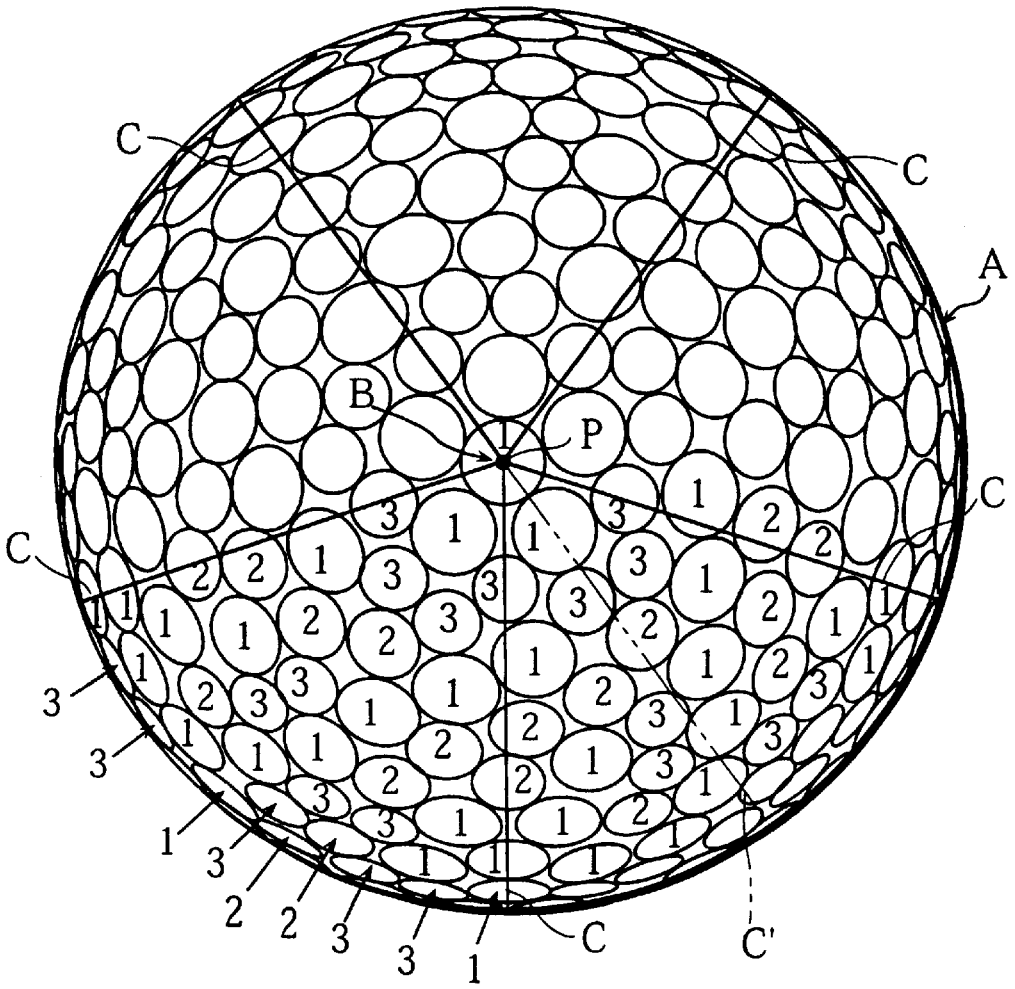
FIG. 2 is a top view showing a preferred embodiment of the golf ball of the present invention.
Figure 3:
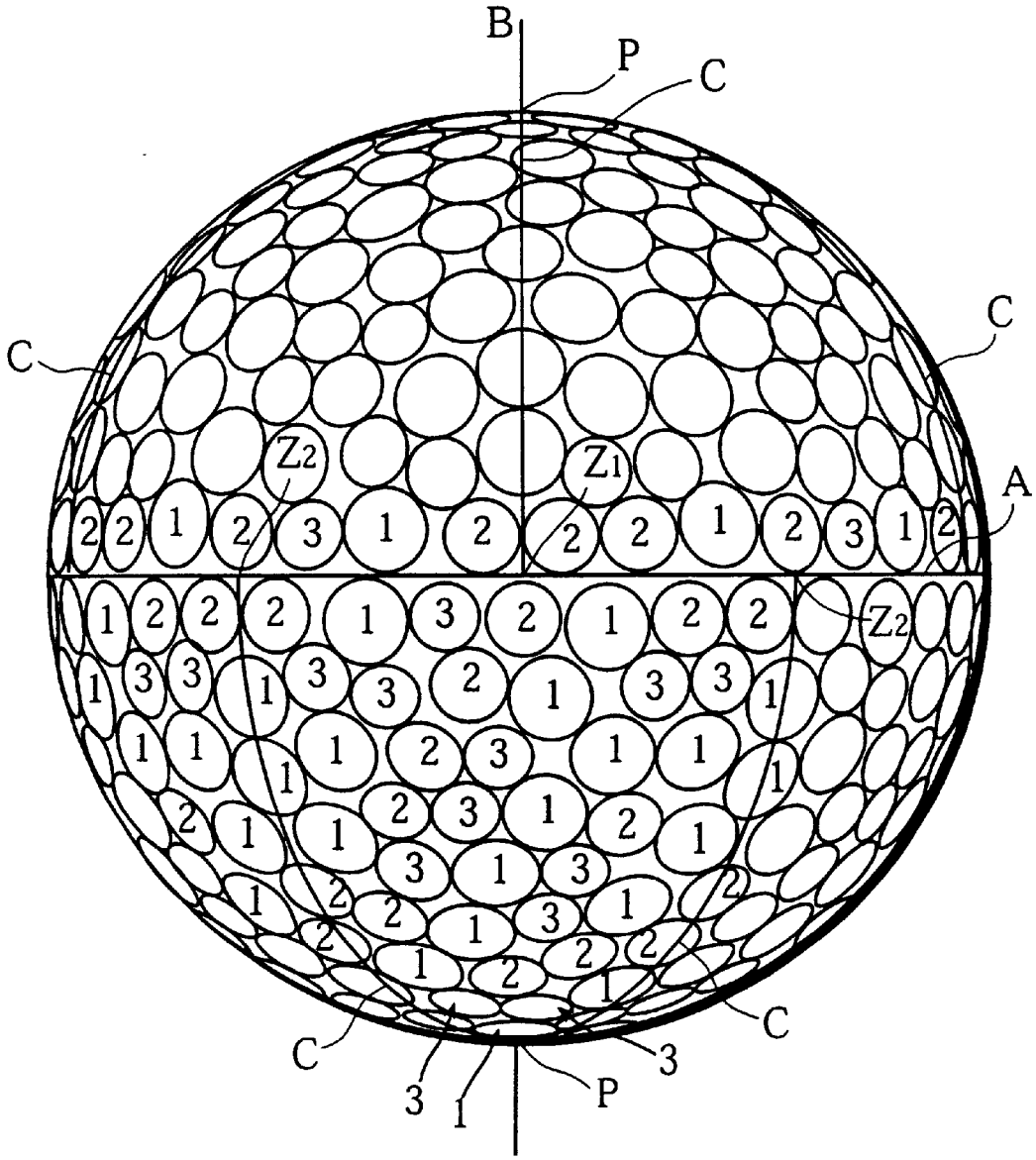
FIG. 3 is a front view showing the preferred embodiment of the golf ball of the present invention.

FIG. 2 and FIG. 3 are a top view and a front view showing a preferred embodiment of a golf ball of the present invention. This golf ball, in which large and small plural kinds of dimples 1, 2, and 3 (three kinds of dimples) are disposed and a great circle zone not crossing even a part of the dimples is formed on a spherical face, is characterized by dimple disposition described later. Furthermore, the great circle zone corresponds to a parting line of a metal mold in the production process, and necessarily exists for production of the golf ball.

Figure 1:
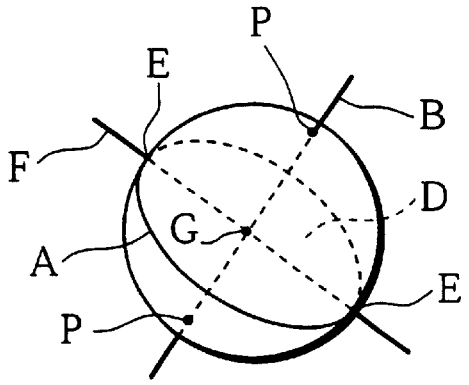
FIG. 1 is an explanatory view showing poles of a golf ball of the present invention.

In addition, as shown in FIG. 1 through FIG. 3, an imaginary great circle line A is drawn on the above great circle zone of the spherical face. Two intersections of the spherical face and a straight line B, which is at right angles with a circular plane D having a circumference on the imaginary great circle line A and goes through the center G of the ball, are poles P. Furthermore, in ball hemispherical faces which border the imaginary great circle line A, a spherical face of the ball is equally divided with five imaginary arc lines C which start from one of the poles P and are at right angles with the imaginary great circle line A.

In this case, with the imaginary great circle line A as a border, the ball is composed of intersections $Z_1$ of the imaginary arc lines C of a ball hemispherical face on one side which do not correspond to intersections $Z_2$ of the imaginary arc lines C of another ball hemispherical face on the other side. Concretely, the ball hemispherical faces are turned (relatively rotated) $360°\div(5\times2)=36°$, and the imaginary arc lines C of the ball hemispherical faces are disposed so as not to correspond with each other.

Therefore, in the golf ball of the present invention, when the ball hemispherical faces are equally divided with the imaginary arc lines C, dimple dispositions of adjacent divided areas sharing one imaginary arc line C are not line-symmetric (axially symmetric) with respect to the imaginary arc line C, and the dimple dispositions of the divided areas are rotation-symmetric (rotationarily symmetric) with respect to the above-mentioned straight line B respectively. That is to say, FIG. 2 and FIG. 3 show a case in which the ball hemispherical face is divided into five equal parts with five imaginary arc lines C, and five divided areas of spherical triangle are formed. Dimple disposition of each divided area is rotation-symmetric of 72° with respect to the straight line B.

In additional, in the golf ball of the present invention, at least one dimple is disposed on one imaginary arc line C so as to cross the imaginary arc line C to prevent dimples from being in a row along the imaginary arc line C. (In this case, not restricted to crossing of the center of the dimple, a part of the dimple may cross the imaginary arc line C.)

Further, this dimple disposition is not such that the dimples are disposed in line symmetry (axial symmetry) in one divided area. In other words, when one divided area is divided into two equal parts with another imaginary arc line C' (shown with an imaginary line), the divided dimple disposition is not line-symmetric with respect to the above-mentioned imaginary arc line C'.

As described above, in the golf ball of the present invention, the degree of designing freedom of dimple disposition greatly increases in comparison with the disposition in a polyhedron system, because dimples in each divided area are disposed in rotation symmetry (rotationary symmetry) as to correspond respectively when the ball is turned for 72° around the straight line B as an axis which goes through the two poles P of the ball. In other words, even if the imaginary arc line C is moved to any position in a circumferential direction of the imaginary great circle line A, the dimple disposition in each divided area does not become line-symmetric with respect to the imaginary arc line C. And for this reason, as shown in FIG. 3, the dimples are not in a row along the great circle zone (imaginary great circle line A) and each imaginary arc line C, and plural kinds of dimples of different diameter and depth are disposed on the whole spherical face entirely and uniformly. Further, maximum dimple effect can be obtained with only one great circle zone (seam line). Consequently, aerodynamic symmetry is improved, and stable flying ability can be obtained.

Figure 4:
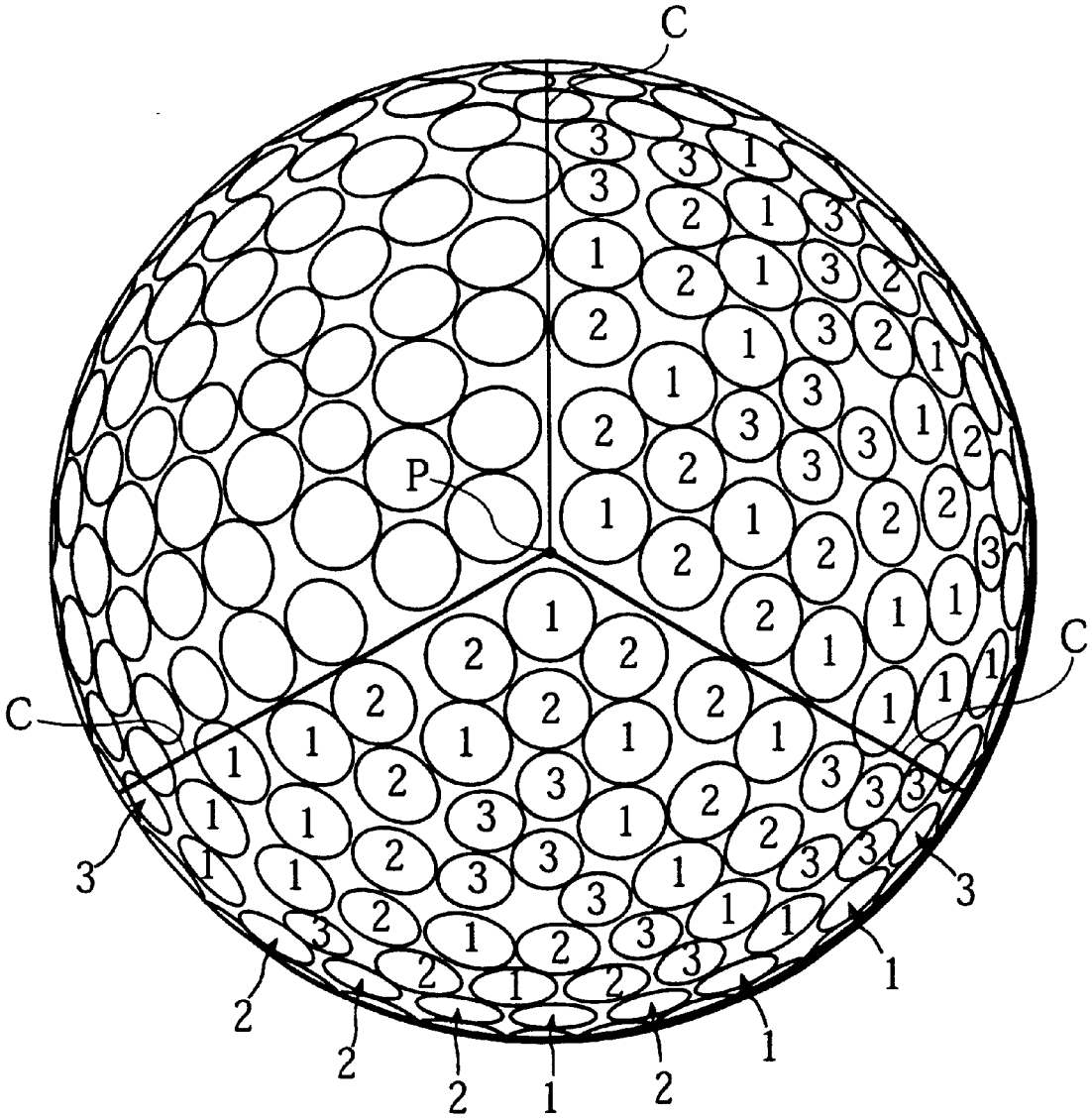
FIG. 4 is a top view showing another preferred embodiment of the present invention.
Figure 5:
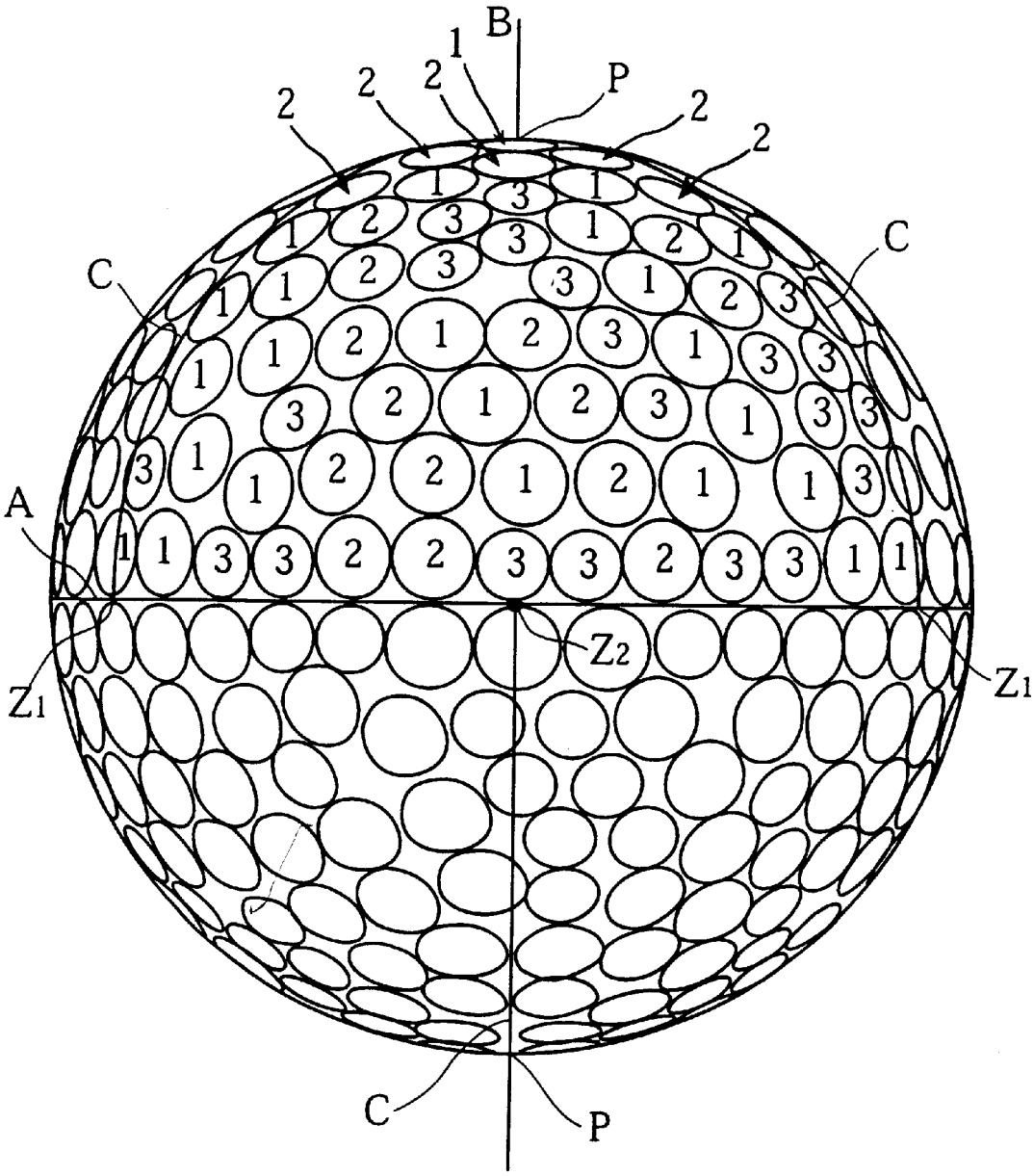
FIG. 5 is a front view showing another preferred embodiment of the present invention.

Next, FIG. 4 and FIG. 5 show another preferred embodiment of the golf ball of the present invention. In a hemispherical face of this golf ball, large and small three kinds of dimples 1, 2, and 3 are disposed in each divided area formed by dividing the hemispherical face into three equal parts with three imaginary arc lines C, and the dimple disposition of each divided area is rotation-symmetric of 120 ° with respect to the straight line B (going through the two poles P). Furthermore, both hemispherical faces are turned as to stagger the phase of two intersections $Z_1$, and $Z_2$ by 60°.

Figure 6:
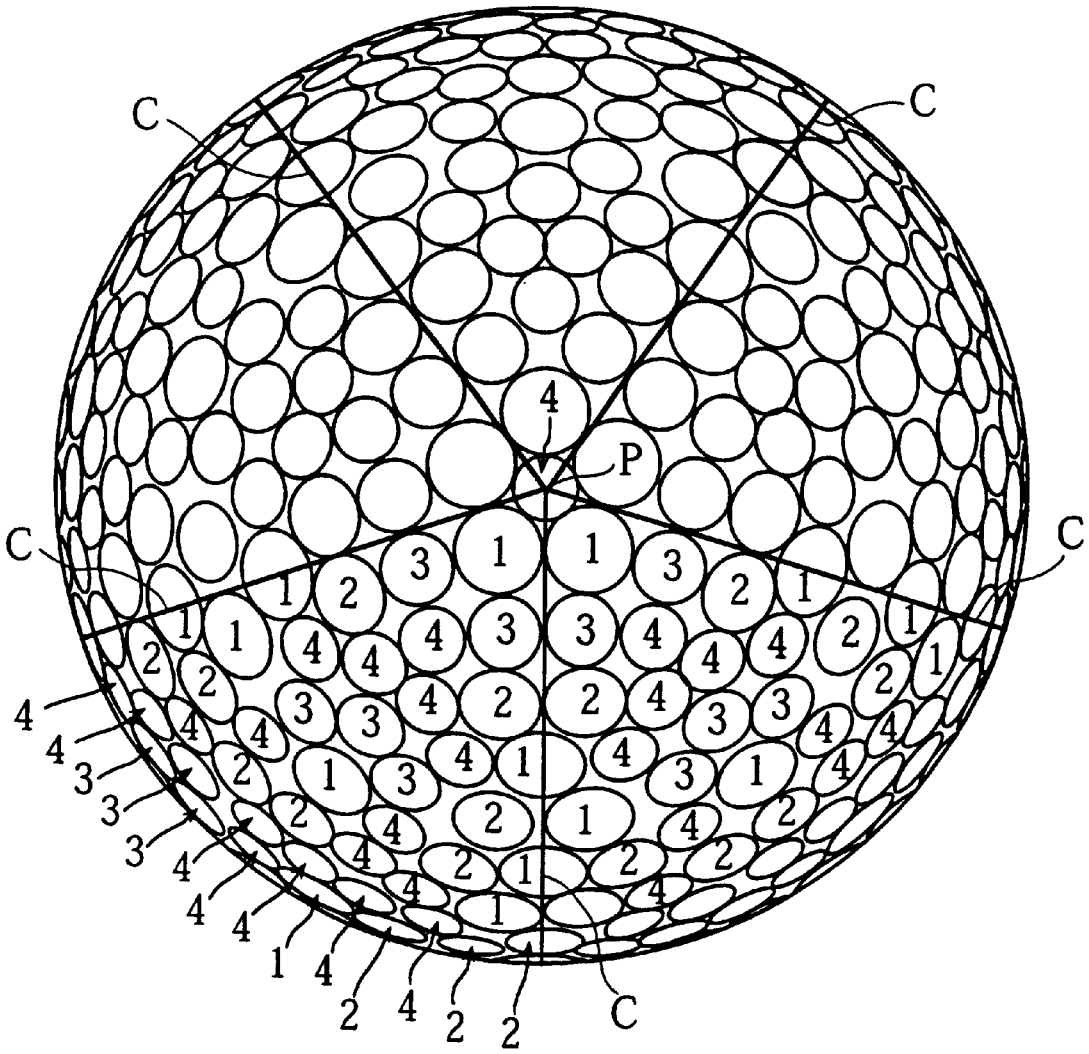
FIG. 6 is a top view showing still another preferred embodiment of the present invention.
Figure 7:
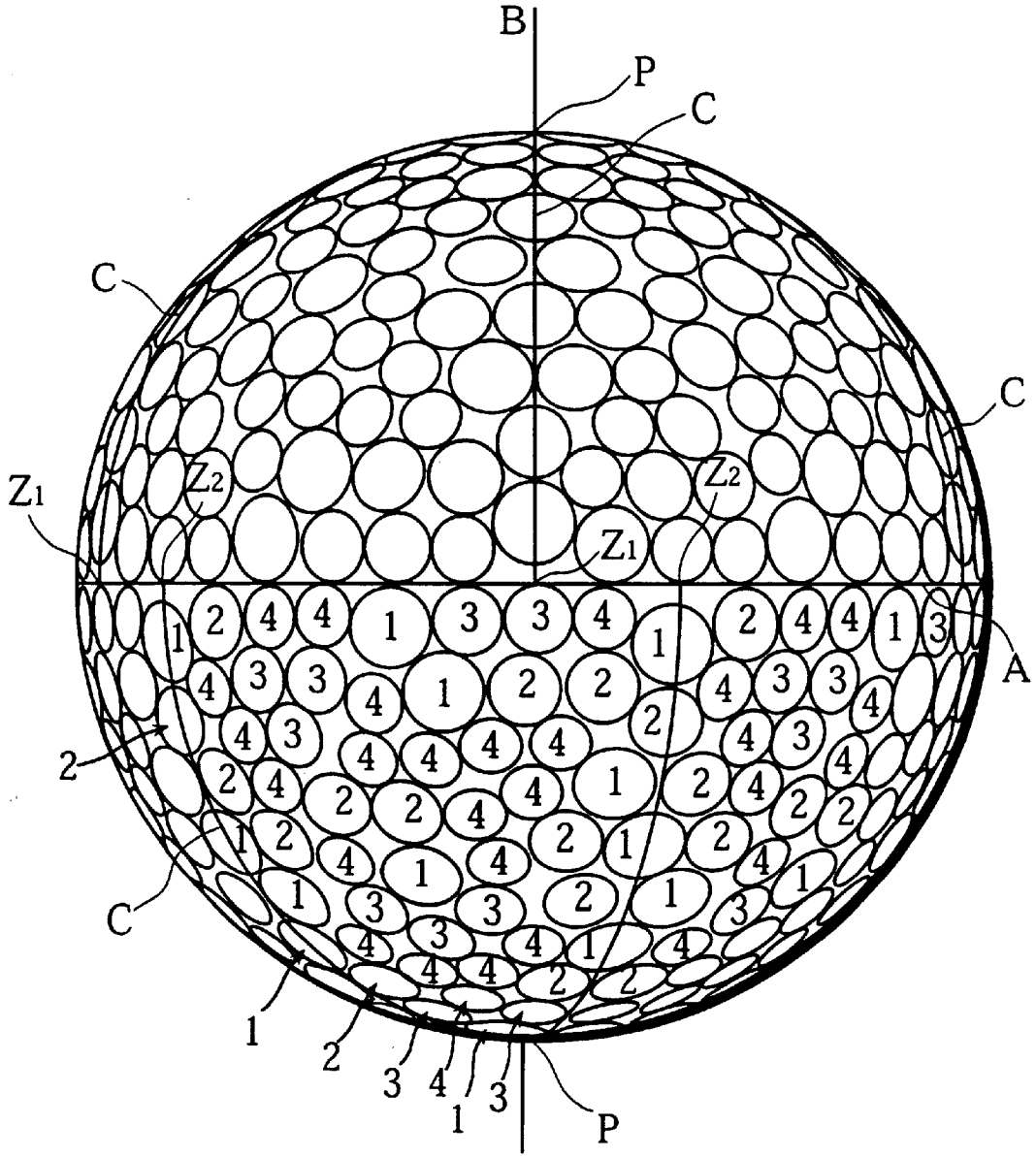
FIG. 7 is a front view showing still another preferred embodiment of the present invention.

In additional, FIG. 6 and FIG. 7 show still another preferred embodiment. In a hemispherical face of this preferred embodiment, large and small four kinds of dimples 1, 2, 3, and 4 are disposed in each divided area formed by dividing the hemispherical face into five equal parts with five imaginary arc lines C, and dimple disposition of each divided area is rotation-symmetric of 72° with respect to the straight line B. Furthermore, the imaginary arc lines C are disposed as to place intersections $Z_1$ and $Z_2$ on proximate positions with each other. And furthermore, in any one of FIG. 4 through FIG. 7, dimple dispositions of adjacent divided areas are not line-symmetric with respect to the imaginary arc line C.

In the present invention, which is not restricted to the preferred embodiments described above, for example, in a ball hemisphere, two equally divided areas may be formed with imaginary arc lines C, and dimple disposition of each divided area may be rotation-symmetric of 180° with respect to a straight line B (going through the two poles P). That is to say, in a top view, the dimple disposition may be point-symmetric with respect to the pole P (not shown in Figures).

Next, concrete examples 1, 2, and 3 of the present invention and a comparison example are shown in an upper part of Table 1. The example 1 is equivalent to the golf ball of FIG. 2 and FIG. 3, the example 2 is equivalent to the golf ball of FIG. 4 and FIG. 5, the example 3 is equivalent to the golf ball of FIG. 6 and FIG. 7, and the comparison example is equivalent to the golf ball of FIG. 8 and FIG. 9.

Figure 8:
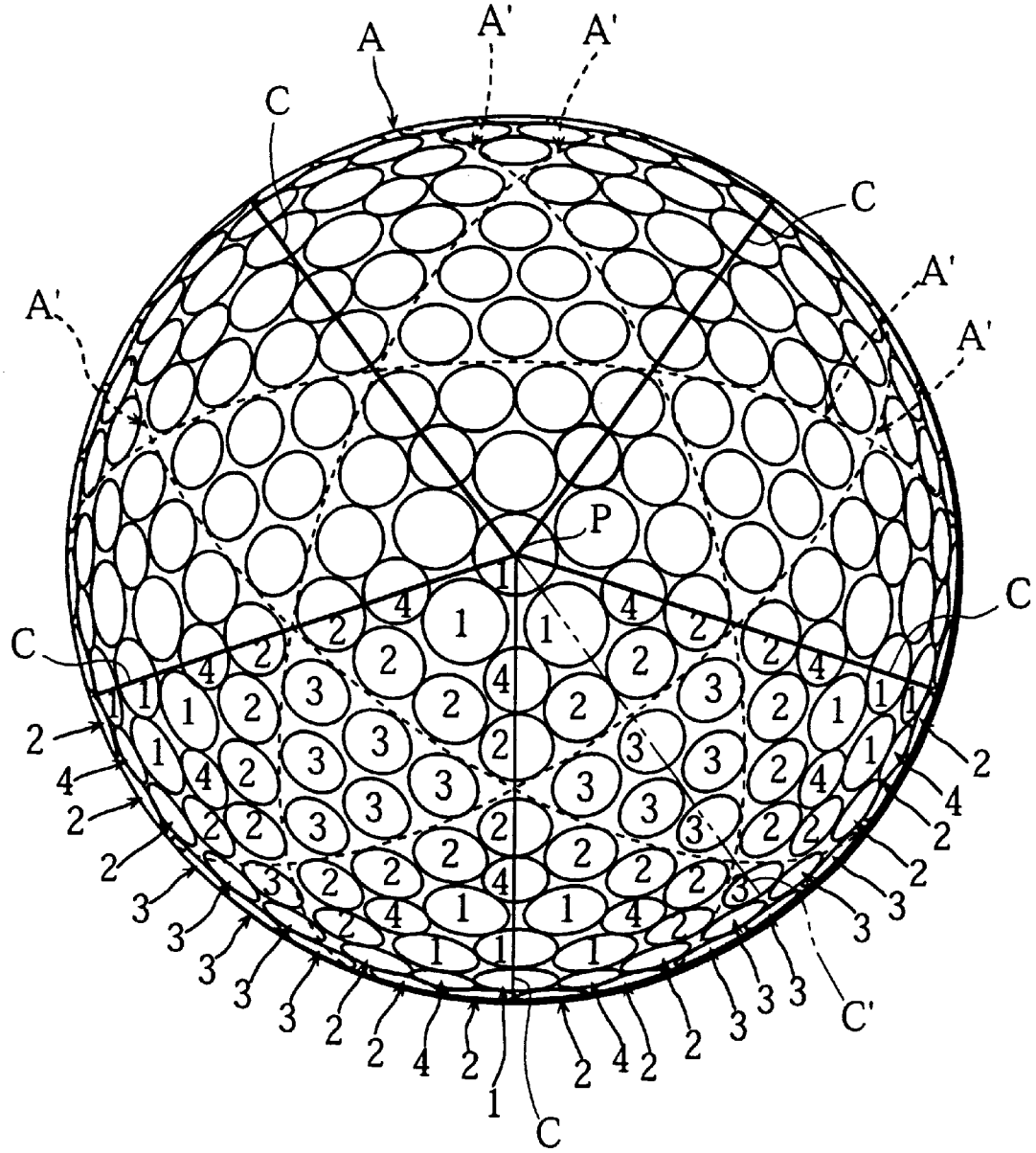
FIG. 8 is a top view showing a comparison example.
Figure 9:
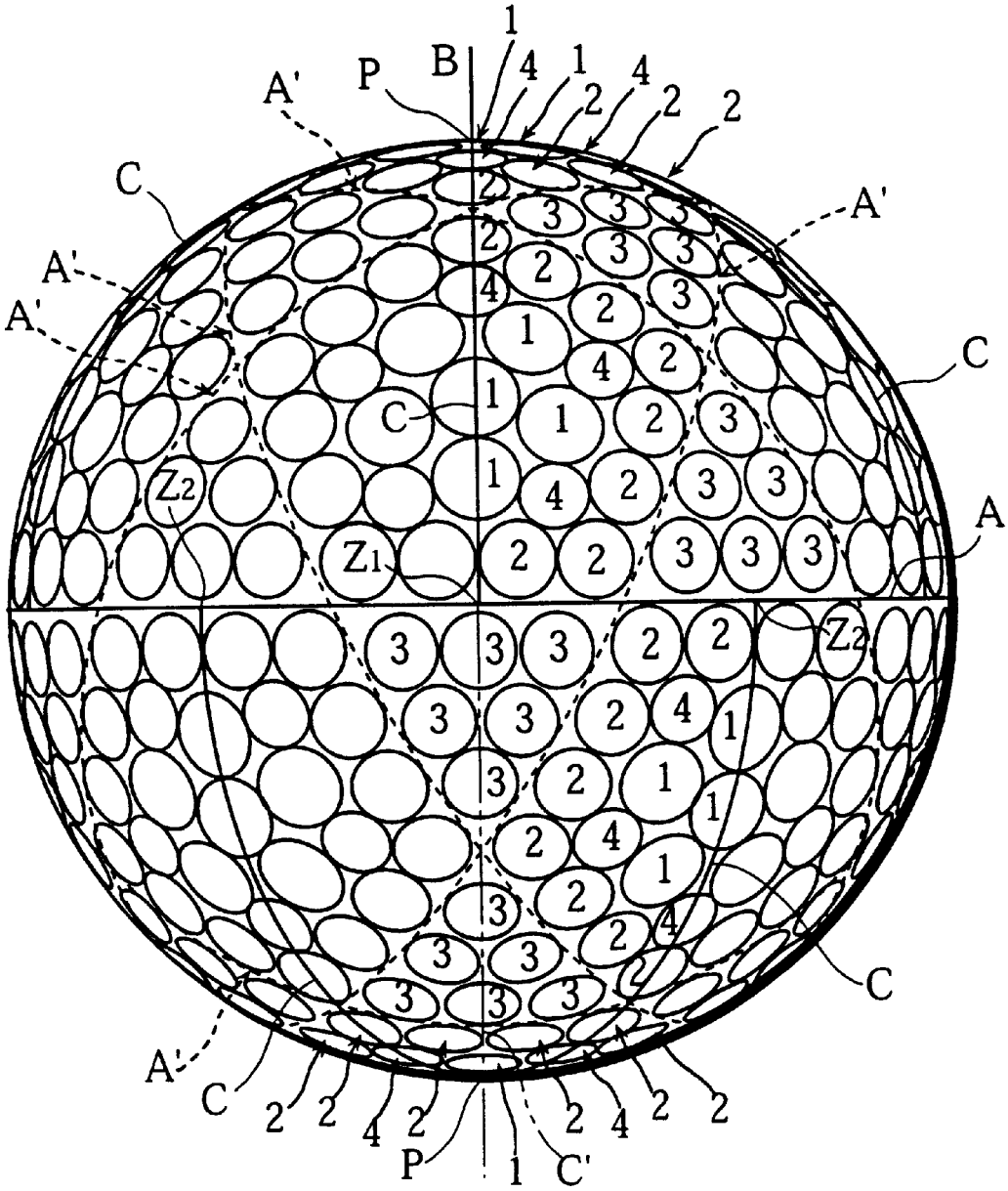
FIG. 9 is a front view showing the comparison example.

The comparison example shown in FIG. 8 and FIG. 9 will be briefly described here. In a hemispherical face of this golf ball, large and small four kinds of dimples 1, 2, 3, and 4 are disposed in each divided area formed by dividing the hemisphere into five equal parts with five imaginary arc lines C, and dimple disposition of each divided area is rotation-symmetric of 72° with respect to the straight line B. The dimples 1, 2, 3, and 4, however, are disposed in line-symmetry with respect to the arc line C, and, when one divided area is divided into two equal parts with another imaginary arc line C' (shown with an imaginary line), each dimple disposition is line-symmetric with respect to the above-mentioned imaginary arc line C'. Furthermore, in this golf ball, the dimples 1, 2, 3, and 4 are disposed in divided areas such that a spherical face is divided so as to be a dodeca-icosahedron with one imaginary great circle line A and five imaginary great circle lines A', and a total six imaginary great circle lines A and A' are six great circle zones not crossing the dimples 1, 2, 3, and 4. Therefore, in this golf ball having the six imaginary great circle lines (great circle zones) A and A', the probability that the rotating direction of the ball corresponds to the great circle lines (great circle zones) A and A' becomes high, and there is a defect in that the flying distance is reduced for remarkably decreased dimple effect.

TABLE 1

| | | EXAMPLE 1 | EXAMPLE 2 | EXAMPLE 3 | COMPARISON EXAMPLE |
|---|---|---|---|---|---|
| TOTAL NUMBER OF DIMPLES | | 432 | 378 | 512 | 432 |
| KIND OF DIMPLES | | | | | |
| DIAMETER (mm)-NUMBER | 1 | 4.00-172 | 4.00-132 | 3.90-90 | 4.00-72 |
| | 2 | 3.50-130 | 3.80-120 | 3.50-120 | 3.50-180 |
| | 3 | 3.20-130 | 3.30-126 | 3.20-100 | 3.30-120 |
| | 4 | | | 2.90-202 | 3.10-60 |
| SYMMETRY TEST | | | | | |
| | | CARRY (yds) | | | |
| POLE-HITTING | | 225.0 | 226.0 | 223.0 | 222.0 |
| SEAM-HITTING | | 224.5 | 225.5 | 222.5 | 220.0 |
| DIFFERENCE | | 0.5 | 0.5 | 0.5 | 2.0 |
| | | TOTAL (yds) | | | |
| POLE-HITTING | | 236.0 | 235.0 | 236.0 | 230.0 |
| SEAM-HITTING | | 237.0 | 235.5 | 237.0 | 235.0 |
| DIFFERENCE | | 1.0 | 0.5 | 1.0 | 5.0 |

Symmetry test was conducted on the example 1, 2, 3, and the comparison example, and results are shown in a lower part of Table 1. In the symmetry test, pole-hitting and seam-hitting are conducted on each golf ball, and carry (flying distance) and total (carry+run) are measured. In this case, as shown in FIG. 1, in pole-hitting, the ball is hit so as to generate back spin of which the rotational axis is a straight line F going through a center of the ball G and two points E on the seam line (imaginary great circle line A) opposite to each other, and in seam-hitting, the ball is hit so as to generate back spin of which the rotational axis is the straight line B.

As shown by the result shown in FIG. 1, symmetry in carry is better in the examples 1, 2, and 3 than that in the comparison example, and symmetry in total is extremely better in the examples 1, 2, and 3 than that in the comparison example. Furthermore, also in flying distance, the examples 1, 2, and 3 are superior to the comparison example in both carry distance and total distance. With these results, it is confirmed that the present invention is excellent in aerodynamic symmetry, having stable flying ability, and effective for increasing flying distance.

According to the golf ball relating to the present invention, the degree of designing freedom is remarkably increased, and more unconventional new patterns can be created. That is to say, plural kinds of dimples of different diameter and depth can be disposed on a whole spherical face uniformly. Furthermore, maximum dimple effect can be obtained for only one great circle zone (seam line). Therefore, aerodynamic symmetry is improved, and stable flying ability can be obtained.

In addition, the ball has only one great circle zone (seam line) not having dimples on the spherical face, and maximum dimple effect can be obtained. Therefore, the probability that the rotational direction (flying direction) of the ball corresponds to the circumferential direction of the great circle zone greatly decreases, and reduction of flying distance is not generated.

Further, even if the dimples do not cross the imaginary arc line C, one imaginary arc line C of a hemisphere on one side and another imaginary arc line C of a hemisphere on the other side do not join together and a great circle zone (seam line) is not formed. Furthermore, dimple disposition of a hemispherical face on one side and dimple disposition of a hemispherical face on the other side do not correspond, and dimples are disposed more uniformly on the whole spherical face.

While preferred embodiments of the present invention have been described in this specification, it is to be understood that the invention is illustrative and not restrictive, because various changes are possible within the spirit and indispensable features.

What is claimed is:

1. A golf ball having a plurality of dimples disposed on a spherical face thereof, said dimples being arranged in non-overlapping manner with a great circle zone formed on the spherical face, comprising:

an imaginary great circle line on the great circle zone;

two poles formed by an intersection of a straight line passing through a center of the ball and at right angles with a circular plane having a circumference formed by the imaginary great circle line;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and the dimple dispositions in each divided area do not become line-symmetric with respect to said one imaginary arc line even if the imaginary arc lines are moved to any position in a circumferential direction of said imaginary great circle line.

2. The golf ball according to claim 1, wherein there are two of said at least one ball hemispherical faces, and intersections of said imaginary arc lines and the imaginary circle line on one of the ball hemispherical faces do not correspond with intersections of said imaginary arc lines and the imaginary circle line of the other of said ball hemispherical faces, and said imaginary great circle line is the border of said two ball hemispherical faces.

3. The golf ball according to claim 1, wherein each of said imaginary arc lines intersect at least one dimple.

4. A golf ball having a plurality of dimples disposed on a spherical face thereof, said dimples being arranged in non-overlapping manner with a great circle zone formed on the spherical face, comprising:

an imaginary great circle line on the great circle zone; two poles formed by an intersection of a straight line passing through a center of the ball and at right angles with a circular plane having a circumference formed by the imaginary great circle line;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and at least one dimple intersects said one imaginary arc line, and the dimple dispositions in each divided area do not become line-symmetric with respect to said one imaginary arc line even if the imaginary arc lines are moved to any position in a circumferential direction of said imaginary great circle line.

5. The golf ball according to claim 4, wherein there are two of said at least one ball hemispherical faces, and intersections of said imaginary arc lines and the imaginary circle line on one of the ball hemispherical faces do not correspond with intersections of said imaginary arc lines and the imaginary circle line of the other of said ball hemispherical faces, and said imaginary great circle line is the border of said two ball hemispherical faces.

6. The golf ball according to claim 4, wherein each of said imaginary arc lines intersect at least one dimple.

7. A golf ball having a plurality of dimples disposed on a spherical face thereof, said dimples being arranged in non-overlapping manner with a great circle zone formed on the spherical face, comprising:

an imaginary great circle line on the great circle zone;

two poles formed by an intersection of a straight line passing through a center of the ball and at right angles with a circular plane having a circumference formed by the imaginary great circle line;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and there are no imaginary arc lines which are line-symmetric with respect to the dimple dispositions of any adjacent equal areas in said one ball hemispherical face.

8. The golf ball according to claim 7, wherein said two poles intersect one of said dimples, respectively.

9. A golf ball having a plurality of dimples disposed on a spherical face thereof, said dimples being arranged in non-overlapping manner with a great circle zone formed on the spherical face, comprising:

an imaginary great circle line on the great circle zone; two poles formed by an intersection of a straight line passing through a center of the ball and at right angles with a circular plane having a circumference formed by the imaginary great circle line;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and at least one dimple intersects said one imaginary arc line, and there are no imaginary arc lines which are line-symmetric with respect to the dimple dispositions of any adjacent equal areas in said one ball hemispherical face.

10. The golf ball according to claim 9, wherein said two poles intersect one of said dimples, respectively.

11. A golf ball having a plurality of dimples disposed on a spherical face thereof, said dimples being arranged in non-overlapping manner with a great circle zone formed on the spherical face, comprising:

an imaginary great circle line on the great circle zone;

two poles formed by an intersection of a straight line passing through a center of the ball and at right angles with a circular plane having a circumference formed by the imaginary great circle line, said two poles intersecting one of said dimples, respectively;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and the dimple dispositions in each divided area do not become line-symmetric with respect to said one imaginary arc line even if the imaginary arc lines are moved to any position in a circumferential direction of said imaginary great circle line.

12. A golf ball having a plurality of dimples disposed on a spherical face thereof, said dimples being arranged in non-overlapping manner with a great circle zone formed on the spherical face, comprising:

an imaginary great circle line on the great circle zone;

two poles formed by an intersection of a straight line passing through a center of the ball and at right angles with a circular plane having a circumference formed by the imaginary great circle line, said two poles intersecting one of said dimples, respectively;

at least one ball hemispherical face having a border along the great circle line, said one ball hemispherical face divided into equal areas by imaginary arc lines extending from one of said poles and at right angles to the imaginary great circle line, and adjacent of said equal areas having dimple dispositions sharing one of the imaginary arc lines are not line-symmetric with respect to said one imaginary arc line, and dimple dispositions of each equal area are rotation-symmetric with respect to said straight line, and at least one dimple intersects said one imaginary arc line, and the dimple dispositions in each divided area do not become line-symmetric with respect to said one imaginary arc line even if the imaginary arc lines are moved to any position in a circumferential direction of said imaginary great circle line.

* * * * *